United States Patent [19]

Svensson

[11] 4,106,247

[45] Aug. 15, 1978

[54] LINTEL FOR SUPPORTING E.G. ARCHES OVER WALL OPENINGS, FACADE COVERINGS AND SIMILAR

[76] Inventor: Lennart Svensson, Tallbacken2, Kungsbacka, Sweden, 434 00

[21] Appl. No.: 802,188

[22] Filed: May 31, 1977

[30] Foreign Application Priority Data

Jun. 1, 1976 [SE] Sweden ..... 7606131
Feb. 15, 1977 [SE] Sweden ..... 7701629

[51] Int. Cl.[2] ..... E06B 1/04
[52] U.S. Cl. ..... 52/204
[58] Field of Search ..... 52/204, 97, 412, 209, 52/58-62, 283, 73, 716; 126/142

[56] References Cited

U.S. PATENT DOCUMENTS 2,486,348 10/1949 Wehr ..... 110/1 A

FOREIGN PATENT DOCUMENTS 247,812 11/1963 Australia ..... 52/283
1,380,485 10/1964 France ..... 52/209
706,218 3/1954 United Kingdom ..... 52/209

*Primary Examiner*—John E. Murtagh
*Attorney, Agent, or Firm*—Holman & Stern

[57] ABSTRACT

A lintel is provided for supporting arches over doors, windows and other openings in the wall. The lintel has a substantially L-shaped cross-section and is made of relatively thin plate. Tension bands are at one of their ends attached to the end of the horizontal leg of the lintel and at their other end connected to the end of the vertical leg of the lintel.

9 Claims, 9 Drawing Figures

LINTEL FOR SUPPORTING E.G. ARCHES OVER WALL OPENINGS, FACADE COVERINGS AND SIMILAR

BACKGROUND OF THE INVENTION

The present invention refers to a lintel for supporting the first course at the walling of e.g. arches over wall openings, brick facades and similar, said lintel having a substantially L-shaped cross section.

When arches over wall openings, as windows and door openings, are walled usually prefabricated prestressed courses of brick are used, which form both the centering and the first course at the walling. Prestressed facade courses are manufactured by solid brick and usually comprise bricks provided with grooves and a prestressed reinforcement are casted into said grooves. In some cases also arches walled in situ are used, at which a wood girder supported by posts, which are removed after the walling, is placed in the wall opening. A third alternative is that an iron girder, e.g. a L- or I-beam is walled in and permanently supports the arch. This alternative is however used only in such cases, e.g. for industrial buildings, where no greater claims for an aesthetical exterior are called for. Also in these cases the separate stones consist of a solid stone material.

Since the facade stones in most cases are hollow blocks and these are manufactured in many different tints and surface structures it is necessary to provide also the solid stones in all these tints and structures, which requires large storage spaces. Besides that it is very difficult to achieve the same tint for a hollow brick as for a solid brick when burning the bricks. Thus it is desirable to be able to use hollow bricks also for the first course when walling an arch, but this has not been possible since the hollow side of the bricks would be visible.

Facade coverings of bricks are always built up at a distance from the house wall, so that a ventilator opening is formed between the wall and the facade covering. The claim for more hard-burnt bricks has also involved that their water absorption ability has been considerably reduced and this has resulted in a formation of fine contraction cracks between the bricks and the mortar joints, said cracks due to capillary effects transport considerable amounts of rainwater from the outside of the facade to the inside of the facade covering. This amount of water can be so big that the water runs along the backside of the facade bricks facing the house wall and serious damages can occur if a satisfactory drainage has not been arranged. Attempts have been made for arranging the drainage above window- and door frames by attaching sealing strips of board or similar, but it has hitherto been difficult to achieve a satisfactory drainage, since the window frame often is mounted at a later occasion and the drainage problem has then not sufficiently been taken into consideration or has even been forgotten.

In many cases it is now also desired that in connection with the facade covering an additional insulation should be applied, which makes the facade covering — bricks — to be situated 10 - 12 cm outside the wall. In such cases L-beams are required, where at least one of the shanks has a length of 130 - 200 mm, which however involves that the running meter costs for such galvanized standard beams will be unreasonably high, at the same time as the L-beam due to its high weight requires extra strong attachment means in the wall and thus means a complication.

Bearing beams are previously known in a plurality of different embodiments. The main part of them implies a fixed connection to the wall behind, which for lintels is a drawback, since the distance between the wall behind and the backside of the mortar in practice impossibly can be kept constant, i.a. due to that the wall never is completely straight and that the bricks have large size tolerances. This results in that the front edge of the lintel will follow the irregularities of the wall and thus be deformed and attain a more or less pronounced arch shape both in the vertical and horizontal direction. An important condition is therefore that lintels are so designed that they do not have to be connected to the wall behind, but at the same time have such a carrying capacity that they can carry the whole load from the arch plus the load loading the arch.

According to a known construction (the British Pat. No. 1.218.082) the lintel is designed as a plate profile and is intended to be walled up in a back brick wall, which is walled up at the same time. This implies that the joints in the front and the back wall are situated at exactly the same height, which practically never is the case. The lintel is further not designed for carrying the load from an arch above a window- or a door opening or the load from a whole facade brick wall, since a deflection of the horizontal shank when subjected to a load cannot be avoided.

It has also been proposed (the British Pat. No. 694.214) to strengthen the lintel by means of stiffeners welded between the shanks of the lintel at a mutual distance corresponding to the length of a brick plus the width of a joint, but since the brick can have a length tolerance of ± 1 cm it is necessary to make the distance between the bricks correspondingly longer. By that the brick course resting on the lintel will have a considerably larger joint width — 5 cm instead of normally 2 cm — which is not acceptable. Besides that the welding of the stiffeners means such a complication and increase in price of the lintel, that it from economical aspects would not be preferable compared to if the thickness of material of the lintel had been increased so much, that the lintel could carry the occuring loads without stiffeners. An additional drawback with the lintels according to the British Pat. No. 694.214 is that it cannot be piled and thus neither can be put overlapping each other, e.g. in such cases where only very short store spaces are available. Another important drawback with welded stiffeners is that only one type of bonding can be laid, at which the freedom of choice is considerably limited. Providing lintels for every kind of bonding is unrealistic even if the above mentioned drawbacks are disregarded.

SUMMARY OF THE INVENTION

The purpose of the present invention is to provide a lintel, which is considerably cheaper than prefabricated brick beams or known profiled beams, and which for one and the same construction fulfils the following demands:

(a) it shall drain off water running at the backside of the brickwork, (b) it shall be so adapted that hollow bricks can be used also for walling of arches, (c) it shall be self-supporting without being fixed to the wall behind, (d) it shall not be a heat transferrer from the building construction behind,
(e) it shall be pileable,
(f) it shall possible to put it with overlap,
(g) it shall have a low weight,
(h) it shall be able to carry considerable loads without the front edge being declined,
(i) it shall be possible to use it independent of what kind of bonding is used,
(j) it shall be possible to use it independent of where the butt joints will be situated,
(k) it shall be possible to section roll it.

According to the invention this have been achieved by a lintel of the kind mentioned in the introduction, said lintel comprising a relatively thin plate profile or similar, the horizontal leg of which at its end is provided with a flanged portion forming an attachment for at least some tension bands arranged in the butt joints between the bricks of the first course, said tension bands at their opposite ends being connected to the end part of the second leg of the lintel, said second leg making an angle with the horizontal leg and said tension bands being displaceable along the lintel for adjustment in a correct position between two bricks.

DESCRIPTION OF SOME PREFERRED EMBODIMENTS

Figure 1:
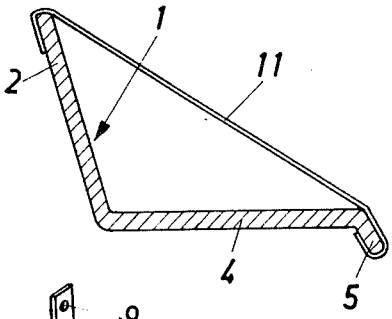
FIG. 1 is a section through a basic embodiment of the lintel according to the invention.

The lintel 1 of the basic embodiment in FIG. 1 has a substantial L-shaped cross-section, at which the angle between the legs 2 and 4 is larger than 90° so that when the leg 4 is horizontally placed the second leg 2 inclines upwards/outwards. The inclined leg 2 can at the mounting of the lintel possibly be brought to contact the body of building and besides serving as a lintel also serves as a discharger for water, that can run at the backside of the facade covering. The horizontal leg 4 is at its free outer end provided with a flanged portion designed as a throating 5. Between the free ends of the legs 2, 4 one or more tensile bands 11, e.g. rustproof threads or -bands, are placed in the butt joint between the bricks, at which a deflection of the horizontal leg 4 of the lintel is prevented.

Figure 2:
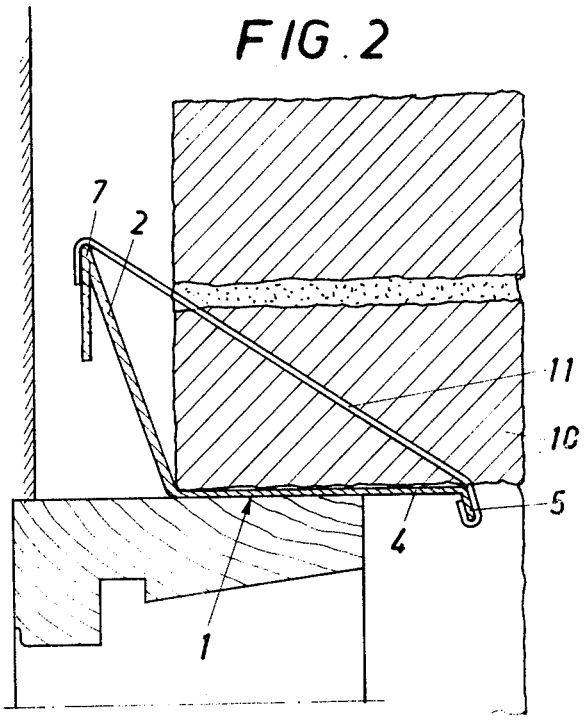
FIG. 2 shows the lintel according to a modified embodiment of the invention applied as an arch support over a door- or window opening.
Figure 3:
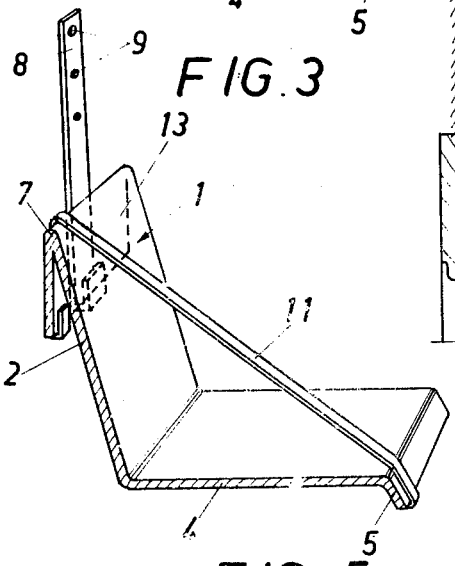
FIG. 3 shows the lintel according to FIG. 2 in perspective and provided with load distribution means.

The lintel 1 according to FIGS. 2 and 3 also has a substantially L-shaped cross-section. The vertical leg 2 of the L in this embodiment however comprises two parts 2, 3 making an angle with each other, said parts forming an inverted V in cross-section.

The first shank 2 of the V is with its end remote from the apex connected to the horizontal leg 4 of the L, while the other shank 3 of the V is substantially perpendicular to the horizontal leg 4. In this way on one hand a carrying proof lintel is obtained and on the other hand a draining surface is obtained, which drains off incoming water by way of the inclined shank 2 and the horizontal leg 4, which at its outer and is provided with a throating 5. The lintel is preferably manufactured either by extruded aluminium or by rolled or flanged plate.

Figure 4:
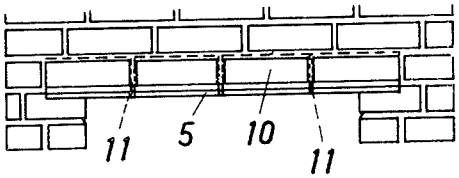
FIG. 4 is a front view of a part of a wall with a wall opening provided with the lintel according to the invention.

The lintel shown in FIGS. 2 and 3 is intended to be used as a combined arch support and water discharger above a wall opening, as a window or a door opening, according to FIG. 4. The end parts of the lintel are laid in mortar, so that the horizontal leg 4 will be situated substantially in level with the lower edge of the next course, after which the bricks 10 are placed directly on the lintel without mortar. Owing to unevennesses in the surfaces of the bricks air slots are formed between the brick and the lintel surface, said slots are large enough for draining of the water which have been collected on the backside of the brick wall. The butt joints of the bricks can by that be filled with mortar, at which also the course situated close to the lintel forms a bonding with the courses situated above and becomes self-supporting after the hardening of the mortar.

Due to the fact that the lintel is designed as described above and as shown in the drawings, its load carrying ability is considerably increased at the same time as the inclined shank 2 effectively leads out all moisture which can be running at the backside of the brick wall. Thus a good carrying capacity of the lintel has been received despite its relatively thin construction. Also the first course can consist of hollow bricks laid in situ, since the underside of the bricks rest against the horizontal leg 4 of the lintel, and the holes are thereby not visible. Solid bricks are therefore not needed any longer for this purpose.

FIG. 3 illustrates how the lintel 1 can be used as a bearing profile for mortar when buildings are covered where supports on the fundament are missing. In such cases where a sufficient attachment for screws cannot be achieved, e.g. when the wall consists of light concrete or similar, it is necessary to distribute the attachment points over a larger surface, and for this purpose load distributing means 8 are used, which according to the embodiment shown are provided with a curved part 13 intended to be hooked together with the vertical shank 3 of the lintel.

Figure 5:
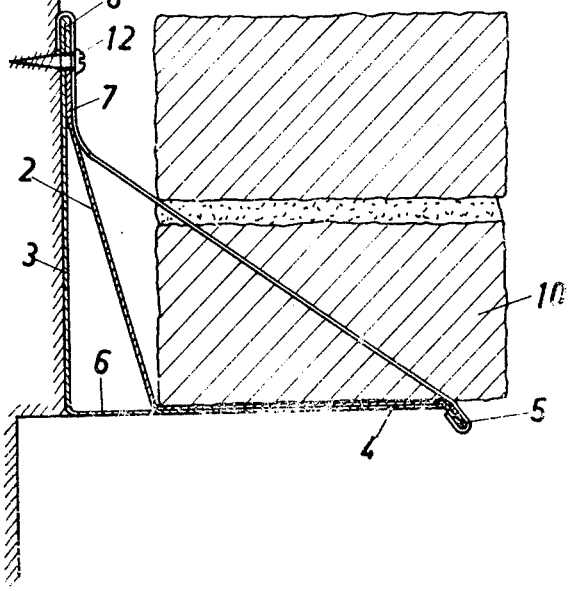
FIG. 5 is a section through a plate lintel designed for carrying a facade covering.

According to the embodiment of FIG. 5 the lintel is made of plate. The double folded plate parts of the lintel are preferably connected to each other, e.g. by point welding. The lintel according to this embodiment is used as a support beam for supporting the facade covering, where the foundation of the building is situated inside the wall rib, and cannot be used as a support. The lintel can e.g. be attached to the wall by means of screws 12. If the lintel is subjected to a relatively high permanent load it can be advantageous to arrange a connection wall 6 between the shanks 2 and 3 of the V, at which said connection wall 6 together with the shanks 2 and 3 form a hollow profile. The apex 7 of the V is according to this embodiment provided with an extended portion, in which holes for attachment members are arranged.

The lintel which is made of a relatively thin plate material achieves its good strength and carrying capacity by using a number of tension bands 11 as is indicated above, said tension bands connect the ends of the legs of the L-shaped lintel. Since the placing of the tension bands is corrected after the placing of the butt joints between the bricks it is necessary that the tension bands can be attached anywhere along the lintel. When attaching the tension band 11 it is preferred not to bend the horizontal leg 4 of the lintel upwards in order to lock the tension band, since a deformation of the lintel could easily occur.

Figure 6:
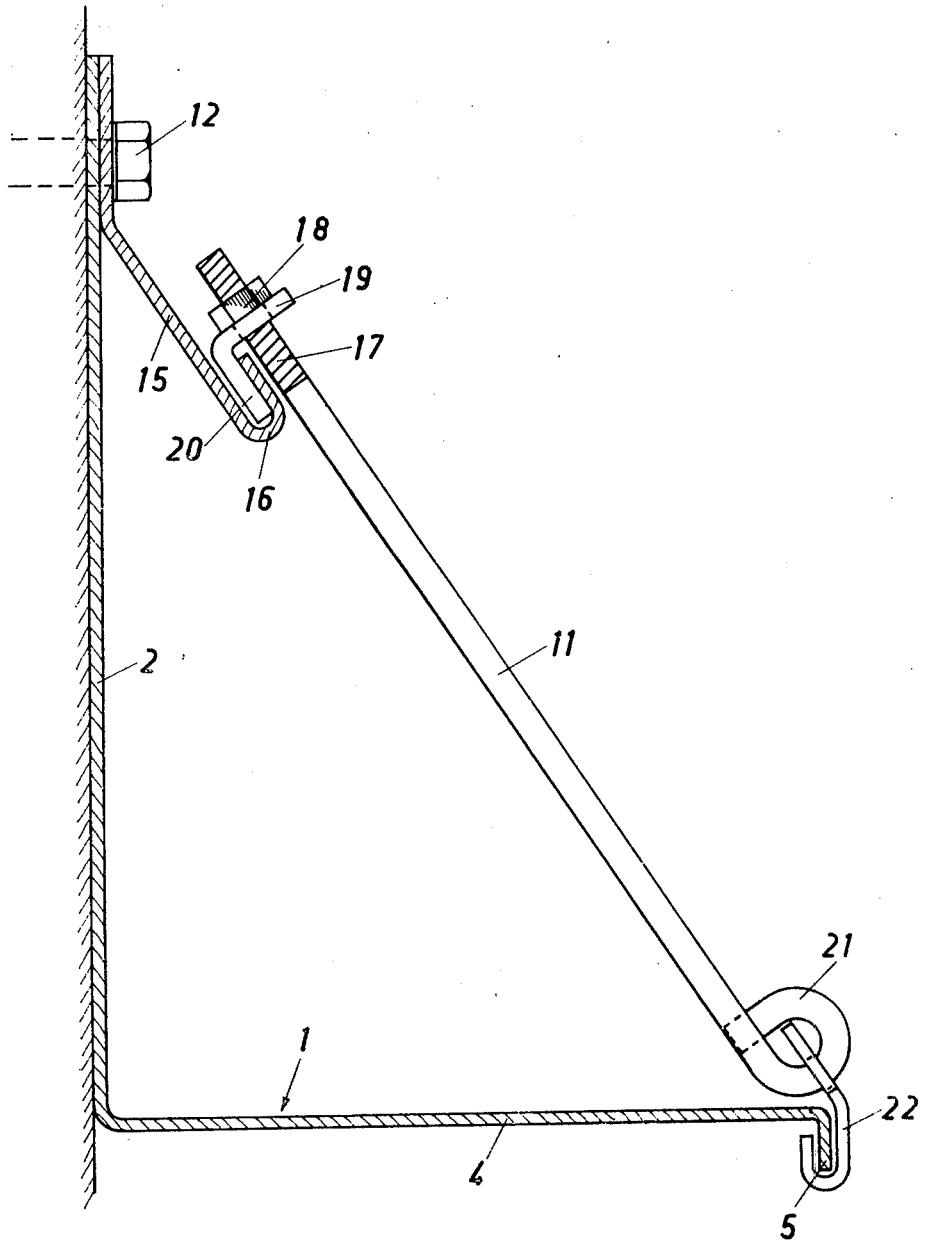
FIG. 6 is a section through a lintel provided with a tensile band adjustable in the longitudinal direction.
Figure 7:
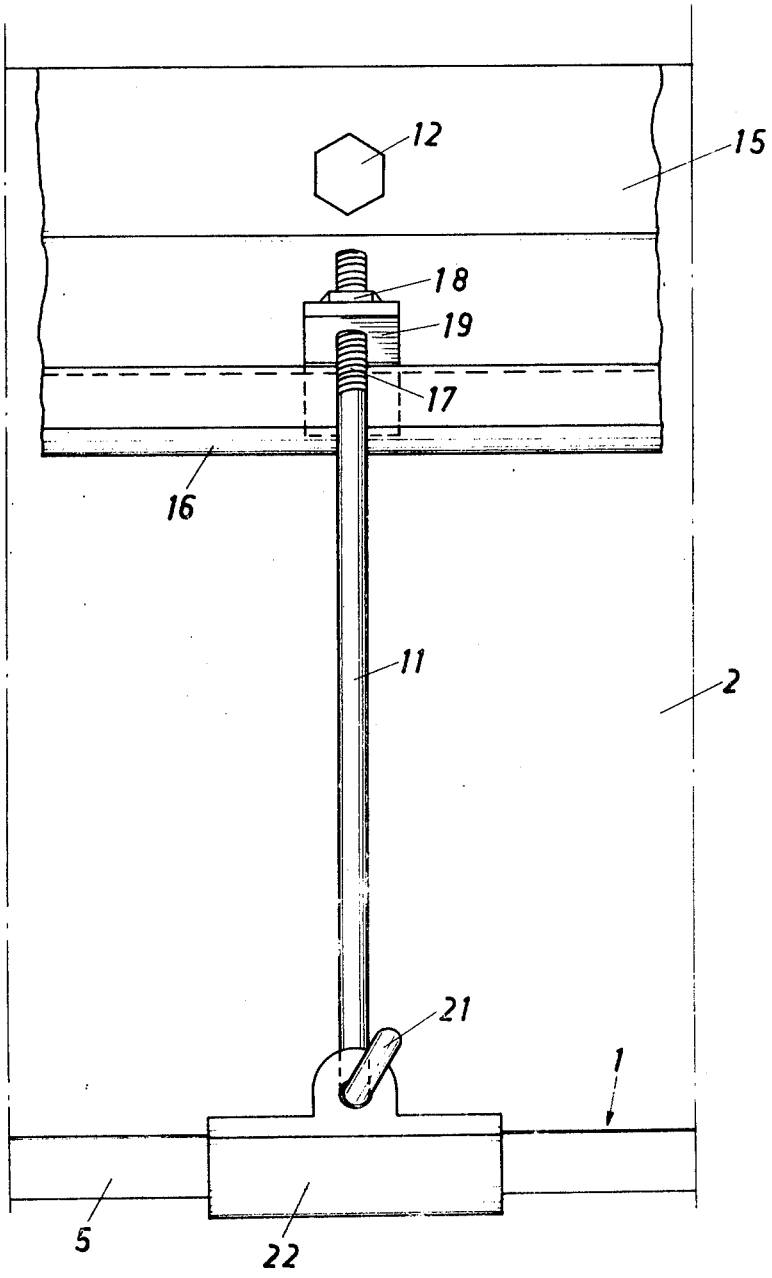
FIG. 7 is a front view of the lintel shown in FIG. 6.

According to the embodiment of FIGS. 6 and 7 showing a L-shaped support lintel, a profiled rail 15 extending along substantially the whole length of the lintel is attached to the upper end of the vertical leg 2 by means of attachment means 12, said profiled bar 15 at its end remote from the lintel being provided with a trench 16.

The tension band 11 comprises a round bar, the upper end of which is provided with threads 17 for a nut 18, which forms a stop for an angle bar 19 passed on the round bar, the leg 20 of the angle bar 19 situated in parallel with the round bar is insertable in the trench 16. The tension band 11 is at its opposite end provided with an open loop or hook 21, on which a crook 22 fitting around the throating 5 of the lintel 1 is passed.

When mounting the lintel to a wall the lintel together with the plate profile 15 is attached on a correct height, after which the crook 22 of the tension band 11 is hitched to the throating 5. At the opposite end of the tension band 11 the nut 18 is placed so that the angle bar 19 can be inserted into the trench 16, after which the nut is tightened until a correct placing and possibly also an inclination (fall) of the horizontal leg 4 has been obtained.

Figure 8:
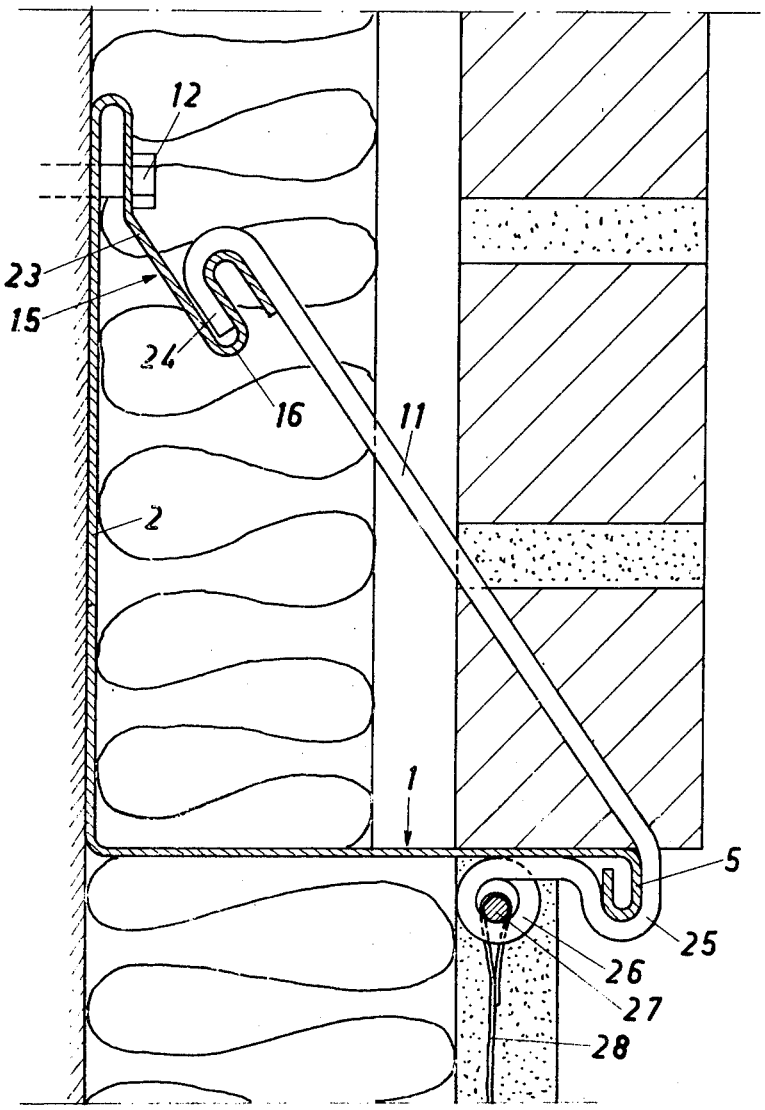
FIG. 8 is a section through a somewhat modified embodiment.

The embodiment according to FIG. 8 differs from the preceding embodiments by the trench-shaped plate profile 15 being integral with the lintel. In order to facilitate the attachment of the tension band 11, the end of the vertical leg has been flanged about 180° and the flanged portion has been provided with a trench 16, which cooperates with a correspondingly flanged portion 24 of the tension band 11. The tension band 11 is at its opposite end provided with a hook-shaped portion 25 intended to receive the throating 5 of the lintel. The hook 25 can be extended and at a distance be provided with a loop 26 serving as an attachment for a bar 27, at which a plaster net 28 or similar is arranged. The net 28 supports a plaster layer protecting the insulation inside.

When mounting the lintel according to FIG. 8 the screws 12 are only tightened so much that the lintel is temporarily supported, after which the tension band 11 is hitched, at which the distance between the vertical leg 2 of the lintel and the flanged portion 23 is chosen so that the tension band 11 without difficulties can be hatched in the trench 16. Since the tension band 11 in this position is too long it must be shortened, which is made by tightening the screw 12, at which the flanged portion 23 is pressed against the leg 1 and a tightening of the tension band 11 is achieved.

Figure 9:
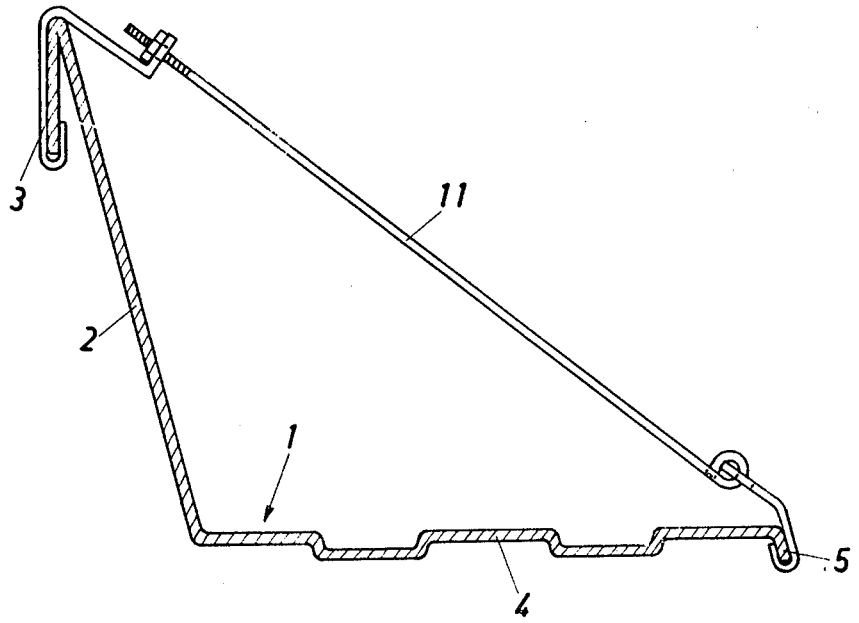
FIG. 9 is a section through a lintel according to a further embodiment.

The lintel according to FIG. 9 differs from the preceding embodiments by its horizontal leg 4 being corrugated in the longitudinal direction of the lintel, at which a stiffer construction with a higher carrying capacity is achieved.

The lintel according to the invention can be used for the following purposes:

1. As an arch support over windows and door openings in masonry of brick and chalky sandstone.

2. In construction courses in masonry of brick and chalky sandstone, where it also can be laid over openings in the foundation wall.

3. As a support for masonry of brick or chalky sandstone when covering buildings, where supports for the masonry are missing on the foundation wall.

4. As a support for masonry of brick or chalky sandstone over long openings in the masonry (e.g. window bands), where the openings are so long that haunches or brick beams cannot be used.

The following advantages are achieved with the lintel according to the invention:

a. The lintel as an arch support is considerably cheaper than prefabricated brick beams and solves at the same time the problem of discharging water running on the backside of the masonry.

b. The width of the lintel is so chosen that hollow bricks can be used without the holes being visible from below. This means great advantages for brick manufacturers, since they do not have to manufacture and keep solid bricks for openings in the masonry in stock. This means advantages also for the consumer, since tint differences are avoided, which otherwise occur when mixing hollow and solid bricks in the same masonry.

c. Since the arch support is placed on supports on both sides of the opening it does not have to be connected or attached to a (bearing) wall behind. This means on one hand that the arch support not makes a heat transferrer and on the other hand that the distance between the wall behind and the brick wall can be varied. If the arch support is attached to a wall behind, which does not consist of the same material as the masonry in which it is walled up, movements would be transferred which would give rise to cracks in the masonry in connection with the arch support. The fact that the arch support does not have to be attached or connected to a wall behind means that it can be used in a great plurality of masonry constructions without loosing any of its advantages.

d. The arch support is so designed that it can be piled, which means that it can be put with overlap over narrow window piers, so that in such cases a sufficient support is achieved.

e. Low weight, since the lintel can be made of a thin plate material.

f. By means of tension bands, which are hidden in the butt joints, loads from the weaker front edge can be transferred, so that the arch support does not have to be posted during the masonry work.

g. The lintel has a better durability and provides a better protection against mechanical damages than plastic or cardboard, which otherwise are used as water dischargers during the first course in masonry of brick or chalky sandstone.

h. Since the rainwater is drained off between the upside of the plate and the underside of the stone certain butt joints do not have to be left open in the first course for draining off rainwater, which has penetrated the masonry. This means that the windproofing properties of the brick wall can be better utilized.

i. Since the load from the masonry can be carried as a tension in the tension band and the support profile resp. instead of as a moment when L-bars are used the support profile can be manufactured of a considerably thinner material than is required for L-bars. As an example it can be mentioned that as a support for a 6,0 m high masonry of chalky sandstone a L-bar with the dimensions 110×110×10 mm is required, while for a corresponding support profile a 1,8 mm thickness of material is required. Thus the lintel as a support profiles is considerably cheaper than e.g. angle bars, which hitherto often have been used in corresponding cases.

j. The support profile causes the stretching force at the attachment point getting lower compared to L-bars. At an inclination of 55° of the tension band the stretching force is reduced with about 30%.

The lintel according to the invention provides several advantages. On one hand it is possible to use light plate profiles even if the bricks will be situated at a considerable distance from a wall, in such cases where an additional insulation inside the bricks shall be arranged. The use of the tension bands means that the stretching force on the attachment means used for attaching the lintel to a wall is reduced. Compared to L-shaped lintels without tension bands the stretching force with the lintel and the tension bands according to the invention is reduced with about 50%. This circumstance is very important, since especially in such buildings consisting of light concrete, hollow bricks or hollow concrete stones, a sufficient attachment for the attachment screws cannot or only with difficulties be achieved.

What I claim is:

1. A lintel for supporting the first course at the walling of e.g. arches over wall openings, brick facades and similar, said lintel having a substantially L-shaped cross section, wherein the lintel comprises a relatively thin plate profile or similar, the horizontal leg of which at its end is provided with a flanged portion or throating forming an attachment for at least some tension bands arranged in the butt joints between the bricks of the first course, said tension bands at their opposite ends being connected to the end part of the second leg of the lintel, said second leg making an angle with the horizontal leg and said tension bands being displaceable along the lintel for adjustment in a correct position between two bricks.

2. A lintel ccording to claim 1 and of the kind for which its second leg comprises two parts making an angle with each other, said parts forming an inverted V in cross section, the first shank of which is fixed to the horizontal leg of the L, said first shank making an obtuse angle with the horizontal leg, and the second shank is arranged substantially perpendicular to said horizontal leg, wherein the space between the shanks of the second leg is free and the legs, shanks and throating are so arranged that the lintels can be piled and be put overlapping each other.

3. A lintel according to claim 1, wherein the length of the tension band is adjustable.

4. A lintel according to claim 3, wherein the tension band comprises a round bar, the upper end of which is provided with threads cooperating with a nut forming a stop for an angle bar passed on the round bar, the shank of said angle bar being parallel with the round bar forms a hook intended to be hatched in a trench-shaped plate profile provided at or connected to the vertical leg of the lintel.

5. A lintel according to claim 4, wherein the lower end of the round bar is loop- or hook-shaped for hatching a tie intended to hitch the throating of the lintel.

6. A lintel according to claim 1, wherein the lintel at the end of the vertical leg is provided with a portion flanged substantially 180°, which at its free end is trench-shaped for cooperation with the tension band, that the flanged portion before the mounting of the lintel is situated at a distance from said leg, and that said leg and the flanged portion are provided with holes for attachment means, said holes being situated just opposite each other.

7. A lintel according to claim 5, wherein at the hook-shaped portion cooperating with the throating of the tension band a hook- or loop-shaped member is arranged, to which a plaster net or similar can be attached.

8. A lintel according to claim 5, characterized in, that at the tie a hook- or loop-shaped member is arranged, to which a plaster net or similar can be attached.

9. A lintel according to claim 1, wherein the horizontal leg of the lintel is provided with corrugations in the longitudinal direction of the lintel.

* * * * *